US010874267B2

(12) United States Patent
Inada et al.

(10) Patent No.: US 10,874,267 B2
(45) Date of Patent: Dec. 29, 2020

(54) TOILET SEAT

(71) Applicant: TOTO LTD., Kitakyushi (JP)

(72) Inventors: Takeshi Inada, Kitakyushu (JP); Takeshi Hayashida, Kitakyushu (JP); Nobuhiko Umeda, Kitakyushu (JP); Shuhei Nishiyama, Kitakyushu (JP); Minoru Sato, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/559,915

(22) Filed: Sep. 4, 2019

(65) Prior Publication Data

US 2020/0100632 A1 Apr. 2, 2020

(30) Foreign Application Priority Data

Sep. 28, 2018 (JP) ..... 2018-183952

(51) Int. Cl.
*A47K 13/02* (2006.01)
*A47K 13/12* (2006.01)

(52) U.S. Cl.
CPC ..... *A47K 13/02* (2013.01); *A47K 13/12* (2013.01)

(58) Field of Classification Search
CPC ..... A47K 13/02; A47K 13/12
See application file for complete search history.

(56) References Cited

U.S. PATENT DOCUMENTS

2017/0071423 A1 3/2017 Hayashida

FOREIGN PATENT DOCUMENTS

| | | | |
|---|---|---|---|
| CN | 107432708 | A | 12/2017 |
| JP | 2000-272014 | A | 10/2000 |
| JP | 2012-045170 | A | 3/2012 |
| JP | 2017-055979 | A | 3/2017 |
| JP | 2018-029720 | A | 3/2018 |
| KR | 10-2009-0077270 | A | 7/2009 |
| KR | 10-2015-0000551 | A | 1/2015 |

*Primary Examiner* — Christine J Skubinna
(74) *Attorney, Agent, or Firm* — Pearne & Gordon LLP

(57) ABSTRACT

A toilet seat includes a bottom plate including a first main part including a first opening, a pair of first hinge parts provided on both side ends of a first back end portion of the first main part, a top plate provided on the bottom plate, the top plate including a second main part including a second opening opposing the first opening and a pair of second hinge parts provided on both side ends of a second back end portion of the second main part, a first bonding member bonding an outer perimeter side of the bottom plate and the top plate, and a second bonding member bonding an inner perimeter side of the bottom plate and the top plate.

6 Claims, 12 Drawing Sheets

TOILET SEAT

CROSS-REFERENCE TO RELATED APPLICATIONS

This application is based upon and claims the benefit of priority from Japanese Patent Application No. 2018-183952, filed on Sep. 28, 2018; the entire contents of which are incorporated herein by reference.

FIELD

Embodiments described herein relate generally to a toilet seat.

BACKGROUND

For example, a toilet seat is configured by bonding a bottom plate provided on the toilet side to a top plate contacted by the buttocks. For example, technology has been known, in which these parts made of resin are bonded by filling a bonding resin into a passageway formed between the parts made of resin (e.g., JP 3733778 B2).

In the toilet seat, it is required to suppress occurrence of a joint, a step and a gap at a bonding part between a top plate and a bottom plate in order to improve cleanability. Comparing a manufacturing method of filling a resin with other manufacturing methods, a toilet seat with high cleanability can be manufactured relatively easily by reducing post process such as grinding and polishing.

Various loads are applied to the toilet seat depending on use scene. For example, it has been known that a large force is applied locally to the toilet seat when seating or fully opening the toilet seat. In particular, in the case where a force is applied to press in a further opening direction (backward) in a state of fully opening the toilet seat, a large force may be applied to a hinge portion and a crack or the like may occur in the hinge portion.

Therefore, in the portion of the hinge of the toilet seat, a separate part with high strength is provided or a volume of the hinge portion (a thickness around the hinge portion) is made large, and thereby rigidity of the hinge portion is made high.

However, in the configuration where the separate part is provided or the volume of the hinge portion is made large, manufacturing cost of the toilet seat is possible to be increased. In the case where the joint or the step occurs in the hinge portion in order to reinforce the hinge portion, the cleanability is decreased as described above. Therefore, it is desired for the toilet seat that high rigidity and high cleanability are obtained from a simple configuration.

SUMMARY

According to an aspect of the invention, a toilet seat includes a bottom plate including a first main part including a first opening, a pair of first hinge parts provided on both side ends of a first back end portion of the first main part, a top plate provided on the bottom plate, the top plate including a second main part including a second opening opposing the first opening and a pair of second hinge parts provided on both side ends of a second back end portion of the second main part, a first bonding member bonding an outer perimeter side of the bottom plate and the top plate; and a second bonding member bonding an inner perimeter side of the bottom plate and the top plate. The first main part includes a first outer edge portion positioned outside the first opening in front of the first back end portion and the pair of first hinge parts. The second main part includes a second outer edge portion positioned outside the second opening in front of the second back end portion and the pair of second hinge parts. The top plate abuts the second edge portion on the first edge portion, abuts the second back end portion on the first back end portion, abuts the pair of second hinge parts on the pair of the first hinge parts, and abuts an open end of the second opening on an open end of the first opening. The second bonding member bonds the open end of the first opening and the open end of the second opening, and The first bonding member bonds the first outer edge portion and the second outer edge portion, bonds the first back end portion and the second back end portion, and bonds the pair of first hinge parts and the pair of second hinge parts. The first main part includes a first portion, a second portion inclined to the top plate side as it goes backward from the first portion, and a third portion between the second portion and the first back end portion. An angle made by a bottom surface of the third portion and a bottom surface of the first portion is smaller than an angle made by the bottom surface of the third portion and a bottom surface of the second portion.

DETAILED DESCRIPTION

Figure 1:
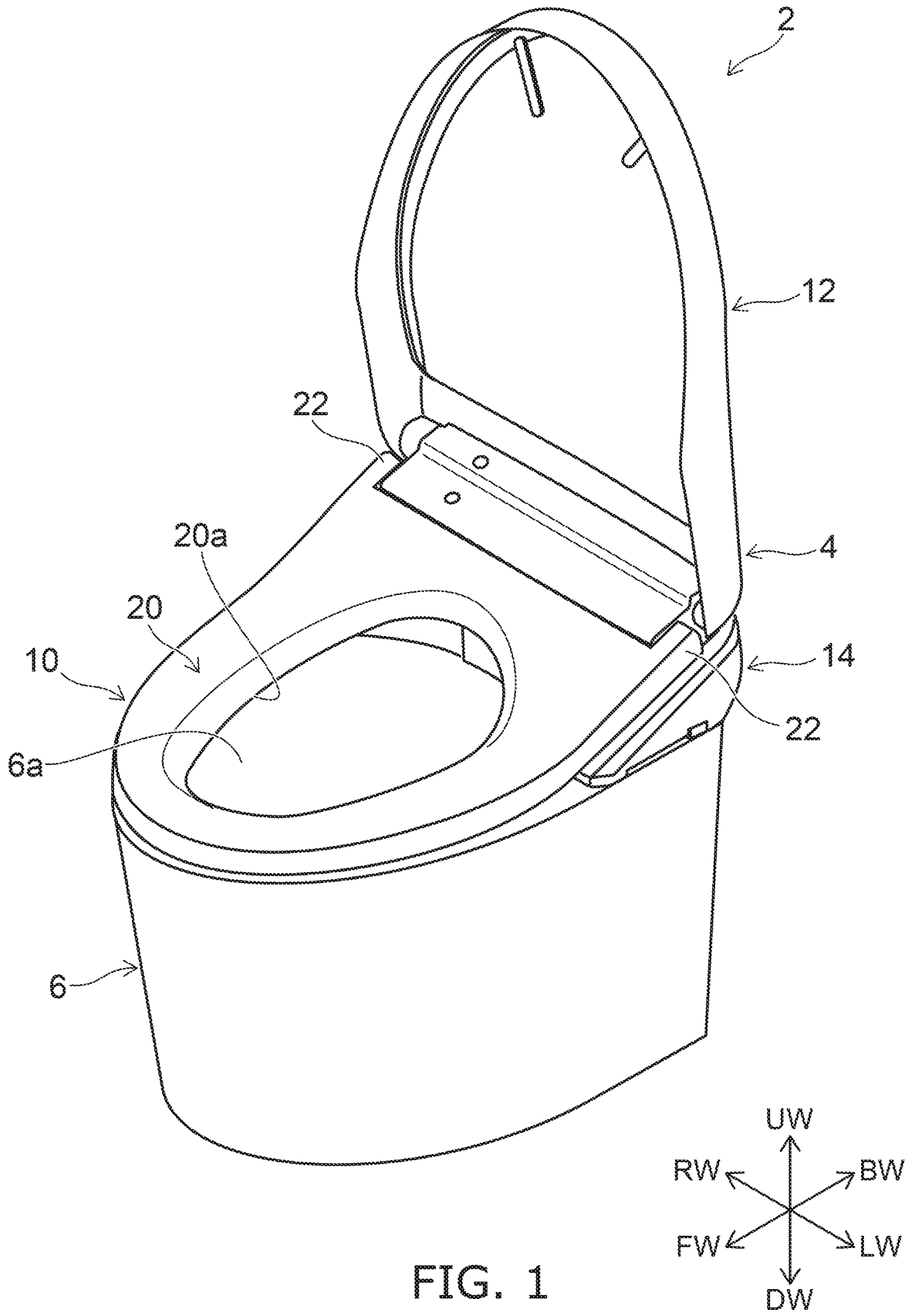
FIG. 1 is a perspective view schematically illustrating a toilet device including a toilet seat according to an embodiment.

The first invention is a toilet seat that includes a bottom plate including a first main part including a first opening, a pair of first hinge parts provided on both side ends of a first back end portion of the first main part; a top plate provided on the bottom plate, the top plate including a second main part including a second opening opposing the first opening and a pair of second hinge parts provided on both side ends of a second back end portion of the second main part; a first bonding member bonding an outer perimeter side of the bottom plate and the top plate; and a second bonding member bonding an inner perimeter side of the bottom plate and the top plate. The first main part includes a first outer edge portion positioned outside the first opening in front of the first back end portion and the pair of first hinge parts. The second main part includes a second outer edge portion positioned outside the second opening in front of the second back end portion and the pair of second hinge parts. The top plate abuts the second edge portion on the first edge portion, abuts the second back end portion on the first back end portion, abuts the pair of second hinge parts on the pair of the first hinge parts, and abuts an open end of the second opening on an open end of the first opening. The second bonds member bonding the open end of the first opening and the open end of the second opening, and The first bonding member bonds the first outer edge portion and the second outer edge portion, bonds the first back end portion and the second back end portion, and bonds the pair of first hinge parts and the pair of second hinge parts. The first main part includes a first portion, a second portion inclined to the top plate side as it goes backward from the first portion, and a third portion between the second portion and the first back end portion. An angle made by a bottom surface of the third portion and a bottom surface of the first portion is smaller than an angle made by the bottom surface of the third portion and a bottom surface of the second portion.

According to the toilet seat, the first bonding member bonds the first outer edge portion and the second outer edge portion, and bonds the pair of first hinge parts and the second hinge parts. Furthermore, the second bonding member bonds the open end of the first opening and the open end of the second opening. In the toilet seat, the pair of hinge parts is formed by bonding the pair of first hinge parts and the second hinge parts. Thereby, in the toilet seat, high rigidity of the pair of hinge parts of the toilet seat is obtained without providing separate parts with high strength and making the volume large. For example, even when the toilet seat is fully open and a force is applied to press it further in the opening direction, it can be suppressed that a crack or the like occurs in the pair of hinge parts. Furthermore, by bonding the inner and outer circumferences of the bottom plate and the top plate by the first bonding member 310 and the second bonding member, it can be suppressed that the joint or the step occurs between the bottom plate and the top plate, and the decrease of cleanability and the decrease of creativity can be suppressed. Therefore, the toilet seat with high rigidity and high cleanability which can be obtained by the simple configuration can be provided.

For example, in the case where the bottom plate includes only the first portion and the second portion, and does not include the third portion, when the bottom plate and the tip plate are bonded by the first bonding member and the second bonding member, the bottom plate may move along the slope of the second portion and deformation of the second portion may occur. On the contrary, in the toilet seat, it can be suppressed that the bottom plate moves along the slope of the second portion and the second portion deforms. Thereby, even when the inclined second portion is provided, the bottom plate and the top plate can be bonded more adequately by the first bonding member and the second bonding member, and higher rigidity can be obtained.

The second invention is the toilet seat of the first invention, wherein the first bonding member bonds the outer perimeter side of the bottom plate and the top plate over an entire circumference, and the second bonding member bonds the inner perimeter side of the bottom plate and the top plate over an entire circumference.

According to the toilet seat, since the first bonding member and the second bonding member bond the outer perimeter side and the inner perimeter side of the bottom plate and the top plate over the entire circumference, high rigidity can be obtained. Furthermore, it can be suppressed that the joint or the step occurs over the entire circumference of the outer perimeter side and the inner perimeter side of the bottom plate and the top plate, and the decrease of cleanability and the decrease of creativity can be more suppressed.

The third invention is the toilet seat of one of the first and second inventions, wherein the bottom plate includes an outer perimeter engaging part and an inner perimeter engaging part. The outer perimeter engaging part is provided along outer perimeter edges of the first main part and the pair of first hinge parts. The outer perimeter engaging part has a recessed shape. The inner perimeter engaging part is provided along an inner perimeter edge of the first main part. The inner perimeter engaging part has a recessed shape. The top plate includes an outer perimeter sidewall part, a first hanging part, a second hanging part, an inner perimeter sidewall part, a third hanging part, and a fourth hanging part. The outer perimeter sidewall part extends downward from outer perimeter edges of the second main part and the pair of second hinge parts. The first hanging part extends downward from a lower end of the outer perimeter sidewall part, overlaps on the bottom plate, and engages with the outer perimeter engaging part. The second hanging part is provided on the lower end of the outer perimeter sidewall part. The second hanging part is disposed on an outer perimeter side than the first hanging part and is separated from the first hanging part. The first hanging part and the second hanging part provide a first recess. The first recess is provided between the first hanging part and the second hanging part and recesses upward. The inner perimeter sidewall part extends downward from an inner perimeter edge of the second main part. The third hanging part extends downward from a lower end of the inner perimeter sidewall part, overlaps on the bottom plate, and engages with the inner perimeter engaging part. The fourth hanging part is provided on the lower end of the inner perimeter sidewall part. The fourth hanging part is disposed on an inner perimeter side than the third hanging part and is separated from the third hanging part. The third hanging part and the fourth hanging part provide a second recess. The second recess is provided between the third hanging part and the fourth hanging part and recesses upward. The first bonding member is provided in the first recess. The second bonding member is provided in the second recess.

According to the toilet seat, in the toilet seat, the first hanging part engaging with the outer perimeter engaging part and the third hanging part engaging with the inner perimeter engaging part are provided, and thus when the bottom plate and the top plate are bonded by the first bonding member and the second bonding member, misalignment of the bottom plate and the top plate can be suppressed. For example, it can be suppressed that the widths of the first bonding member and the second bonding member change due to the misalignment of the top plate, and bias of the bonding strength occurs.

The fourth invention is the toilet seat of the third invention, wherein a ratio of a width of the first hanging part provided on an outer perimeter edge of the pair of second hinge parts to a width of the outer perimeter engaging part provided on an outer perimeter edge of the pair of first hinge parts is smaller than a ratio of a width of the first hanging part provided on an outer perimeter edge of the second outer edge portion to a width of the outer perimeter engaging part provided on an outer perimeter edge of the first outer edge portion, a ratio of a width of the first hanging part provided on an outer perimeter edge of the second back end portion to a width of the outer perimeter engaging part provided on an outer perimeter edge of the first back end portion, and a ratio of a width of the third hanging part to a width of the inner perimeter engaging part.

The portions of the pair of first hinge parts and the pair of second hinge parts have complicated shapes in comparison with the first main part and the second main part, and it is easy to concentrate stress when bonding with the first bonding member and the second bonding member. In the toilet seat, for the portions of the pair of first hinge parts and the pair of second hinge parts, a ratio of the width of the first hanging part to the width of the outer perimeter engaging part is made smaller than that of the other portions. Thereby, in the portions of the pair of first hinge parts and the pair of second hinge parts, a play can be more provided than in the other portions when engaging the outer perimeter engaging part with the first hanging part. The concentration of the stress to the portions of the pair of first hinge parts and the pair of second hinge parts can be relaxed by the play of the engagement of the outer perimeter engaging part and the first hanging part. For example, it can be suppressed that the toilet seat is manufactured in the state in which a residual stress occurs in the portions of the pair of first hinge parts and the pair of second hinge parts. It can be suppressed that, in the case where the toilet seat is fully open and a force is applied to press it further in the opening direction, the crack or the like is easy to occur in the pair of hinge parts by the residual stress. Therefore, the rigidity of the toilet seat can be more increased.

The fifth invention is the toilet seat of the fourth invention, wherein an outer side surface of the first hanging part provided the outer perimeter edge of the pair of second hinge parts is disposed to be separated from the outer perimeter engaging part, and a part of the first bonding member enters between the outer side surface of the first hanging part provided on the outer perimeter edge of the pair of second hinge parts and the outer perimeter engaging part.

According to the toilet seat, the part of the first bonding member enters between the outer side surface of the first hanging part provided on the outer perimeter edge of the pair of second hinge parts and the outer perimeter engaging part. Thereby, it can be suppressed that an air gap occurs between the first hanging part and the outer perimeter engaging part. Thereby, it can be suppressed that, even when the play of the engagement of the outer perimeter engaging part and the first hanging part is made large, the rigidity is decreased due to the play. The rigidity of the pair of hinge parts can be more improved, while suppressing the residual stress from occurring in the portions of the pair of first hinge parts and the pair of second hinge parts.

The sixth invention is the toilet seat of one of the third to fifth inventions, wherein the second hanging part and the fourth hanging part are disposed at a position where the second hanging part and the fourth hanging part do not overlap the bottom plate in a vertical direction. The first bonding member includes a first exposed surface exposing externally between the second hanging part and the bottom plate, the second bonding member includes a second exposed surface exposing externally between the fourth hanging part and the bottom plate, the first exposed surface is disposed on an outer perimeter side of a center in a width direction of the lower end of the outer perimeter sidewall part, and the second exposed surface is disposed on an inner perimeter side of a center in a width direction of the lower end of the inner perimeter sidewall part.

According to the toilet seat, the first exposed surface is disposed on the outer perimeter side of the center in the width direction of the lower end of the outer perimeter sidewall part, and the second exposed surface is disposed on the inner perimeter side of the center in the width direction of the lower end of the inner perimeter sidewall part, and thus the bonding strength by the first bonding member and the second bonding member can be more improved. Therefore, the rigidity of the toilet seat can be more improved.

Various embodiments are described below with reference to the accompanying drawings. In the drawings, similar components are marked with like reference numerals, and a detailed description is omitted as appropriate.

FIG. 1 is a perspective view schematically illustrating a toilet device including a toilet seat according to an embodiment.

As illustrated in FIG. 1, a toilet device 2 includes a toilet seat device 4, and a western-style sit-down toilet (hereinbelow, called simply the "toilet") 6.

The toilet set device 4 is mounted on a toilet 6. The toilet seat device 4 may be mounted as one body with the toilet 6 or may be detachably mounted to the toilet 6. The toilet seat device 4 includes a toilet seat 10, a toilet lid 12, and a main part 14.

In this specification, upward when viewed by the user sitting on the toilet seat 10 is taken as "upward;" and downward when viewed by the user sitting on the toilet seat 10 is taken as "downward." The lateral directions when viewed by the user sitting on the toilet seat 10 with the user's back facing the toilet lid 12 in the open state are respectively taken as "leftward" and "rightward;" and the frontward and backward directions are respectively taken as "frontward" and "backward." FIG. 1 illustrates an example of upward UW, downward DW, leftward LW, rightward RW, frontward FW, and backward BW.

The toilet 6 includes a bowl part 6*a* recessed downward. The toilet 6 receives, in the bowl part 6*a*, excrement such as urine, feces, etc., of the user. The main part 14 of the toilet seat device 4 is provided at the upper part of the toilet 6 backward of the bowl part 6*a*. The main part 14 is pivotally supported by the toilet seat 10 and the toilet lid 12 to be openable and closable.

The toilet seat 10 includes a toilet seat main body 20 and a pair of hinge parts 22. The toilet seat main body 20 has an opening 20*a*. Toilet seat 10 disposes the toilet seat main body 20 on the toilet 6 to surround the outer edge of the bowl part 6*a*, and exposes the bowl part 6*a* via the opening 20*a*. Thereby, the user can excrete into the bowl part 6*a* in the state of sitting on the toilet seat main body 20 of the toilet seat 10. In the example, a so-called O-shaped toilet seat main body 20 is shown in which the opening 20*a* is formed in a through-hole configuration. The toilet seat main body 20 is not limited to being O-shaped and may be U-shaped, etc. A heater that warms the seating part (the part contacted by the buttocks of the user), etc., may be provided as appropriate inside the toilet seat main body 20.

The pair of hinge parts 22 is provided on both side ends of the back end portion of the toilet seat main body 20. Thereby, the toilet seat 10 is pivotally supported to be rotatable on the main part 14 of the toilet seat device 4 via the pair of hinge parts 22. The pair of hinge parts 22 is, for example, provided to protrude backward from the both side ends of the back end portion of the toilet seat main body 20. The pair of hinge parts 22 has, for example, an almost rectangular box shape. However, the shape of the pair of hinge parts 22 is not limited as described above, and may be an arbitrary shape that the toilet seat 10 is able to be pivotally supported to be rotatable on the main part 14.

Figure 2:
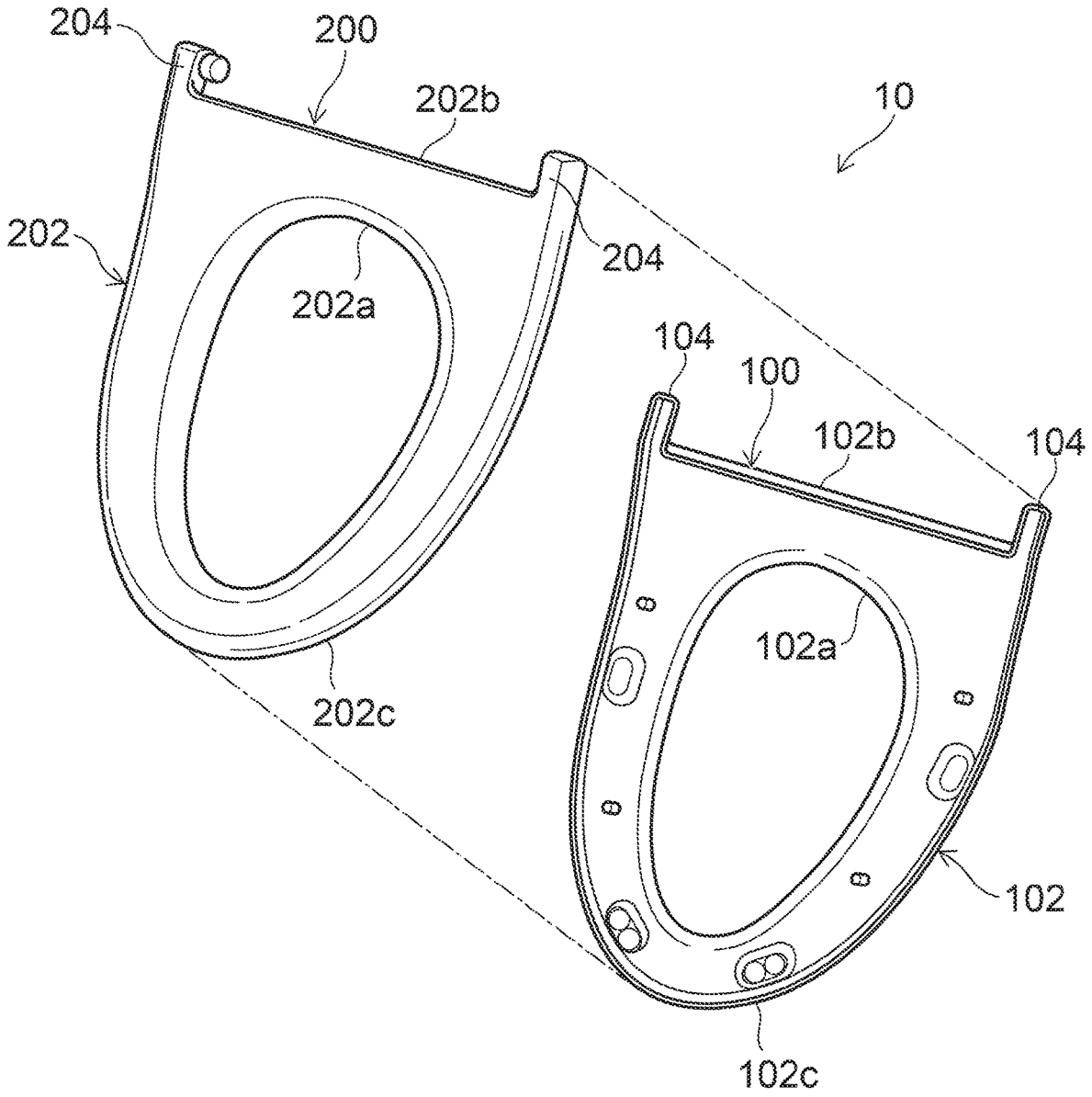
FIG. 2 is an exploded perspective view schematically illustrating the toilet seat according to the embodiment.

FIG. 2 is an exploded perspective view schematically illustrating the toilet seat according to the embodiment.

Figure 3:
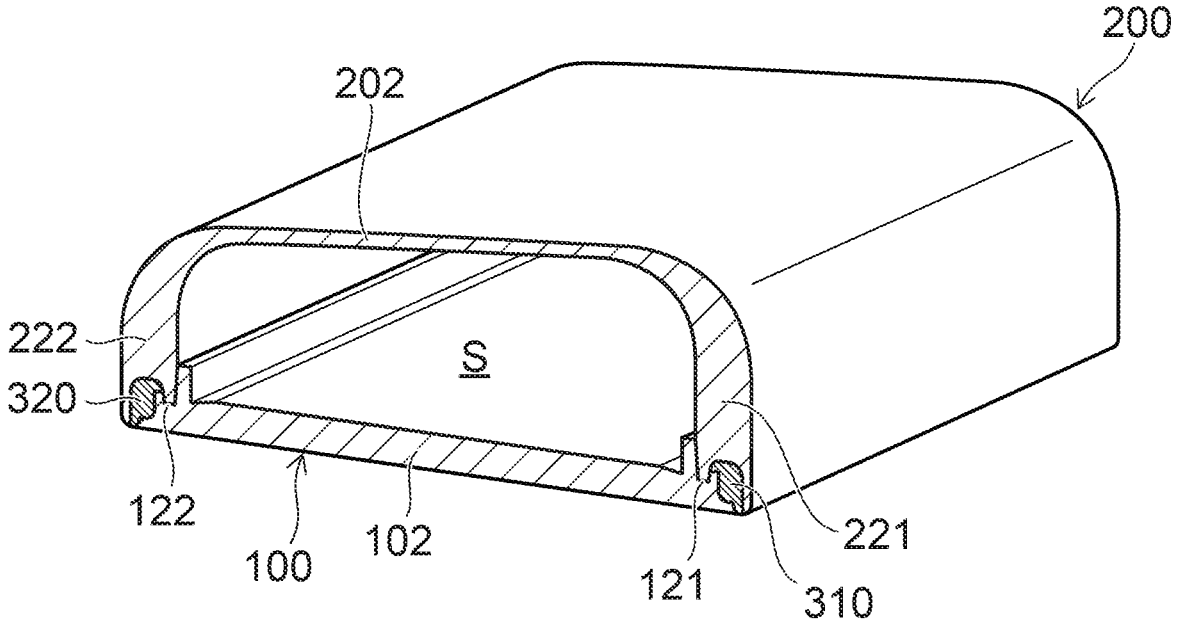
FIG. 3 is a perspective cross sectional view schematically illustrating a portion of the toilet seat according to the embodiment.

FIG. 3 is a perspective cross sectional view schematically illustrating a part of the toilet seat according to the embodiment.

As illustrated in FIG. 2 and FIG. 3, the toilet seat 10 includes a bottom plate 100 and a top plate 200. The top plate 200 is provided on the bottom plate 100; and the bottom plate 100 and the top plate 200 are bonded by a bonding member 310 and a bonding member 320.

A more specific structure of the toilet seat 10 will now be described. Here, the directions of "upward," "downward," etc., are referenced to the state in which the bottom plate 100 of the toilet seat 10 is placed on a horizontal surface (the state in which the bottom plate 100 is placed on the toilet 6, and the user is able to seat).

The bottom plate 100 includes a first main part 102 and a pair of first hinge parts 104. The first main part 102 has a first opening 102*a*. The pair of first hinge parts 104 is provided on both side ends of a first back end portion 102*b* of the first main part 102. The pair of first hinge parts 104 is, for example, provided to protrude backward from the both side ends of the first back end portion 102*b* of the first main part 102.

The first main part 102 includes a first outer edge portion 102*c*. The first outer edge portion 102*c* is positioned outside the first opening 102*a* in front of the first back end portion 102*b* and the pair of first hinge parts 104. The first outer edge portion 102*c* is, for example, the almost U-shaped entire portion frontward of the first back end portion 102*b* and the pair of first hinge parts 104.

The top plate 200 includes a second main part 202 and a pair of second hinge parts 204. The second main part 202 has a second opening 202*a* opposes the first opening 102*a*. The pair of second hinge parts 204 is provided on both side ends of a second back end portion 202*b* of the second main part 202. The pair of second hinge parts 204 is, for example, provided to protrude backward from the both side ends of the second back end portion 202*b* of the second main part 202.

The second main part 202 includes a second outer edge portion 202*c*. The second outer edge portion 202*c* is positioned outside the second opening 202*a* frontward of the second back end portion 202*b* and the pair of second hinge parts 204. The second outer edge portion 202*c* is, for example, the almost U-shaped entire portion frontward of the second back end portion 202*b* and the pair of second hinge parts 204.

The shape of the bottom plate 100 and the top plate 200 as viewed from above is substantially the same as the shape of the toilet seat 10 as viewed from above. That is, the shape of the bottom plate 100 and the top plate 200 viewed from above is circular or U-shaped.

The top plate 200 abuts the second outer edge portion 202*c* on the first outer edge portion 102*c*, abuts the second back end portion 202*b* on the first back end portion 102*b*, abuts the pair of second hinge parts 204 on the pair of the first hinge parts 104, and abuts the open end of the second opening 202*a* on the open end of the first opening 102*a*.

As illustrated in FIG. 3, the first bonding member 301 bonds outer perimeter sides of the bottom plate 100 and the top plate 200. The second bonding member 320 bonds inner perimeter sides of the bottom plate 100 and the top plate 200.

The toilet seat main body 20 of the toilet seat 10 is formed by bonding the first main part 102 of the bottom plate 100 and the second main part 202 of the top plater 200. The opening 20*a* is formed of the first opening 102*a* and the second opening 202*a* by bonding the first main part 102 and the second main part 202. The pair of hinge parts 22 is formed by bonding the pair of first hinge parts 104 and the pair of the second hinge parts 204. The pair of second hinge parts 204 has, for example, an opening box shape which opens downward. The rotation axis portion of the pair of hinge parts 22 is, for example, provided in the pair of second hinge parts 204. The pair of first hinge parts 104 has, for example, a plate shape which blocks the opening downward of the pair of second hinge parts 204. However, the rotation axis portion of the pair of hinge parts 22 may be provided in the pair of first hinge parts 104, and may be formed by bonding the first hinge parts 104 and the second hinge parts 204. However, as described above, the pair of first hinge parts 104 and the pair of second hinge parts 204 can be easily bonded by providing the rotation axis portion of the pair of hinge parts 22 in the pair of second hinge parts 204.

Figure 4:
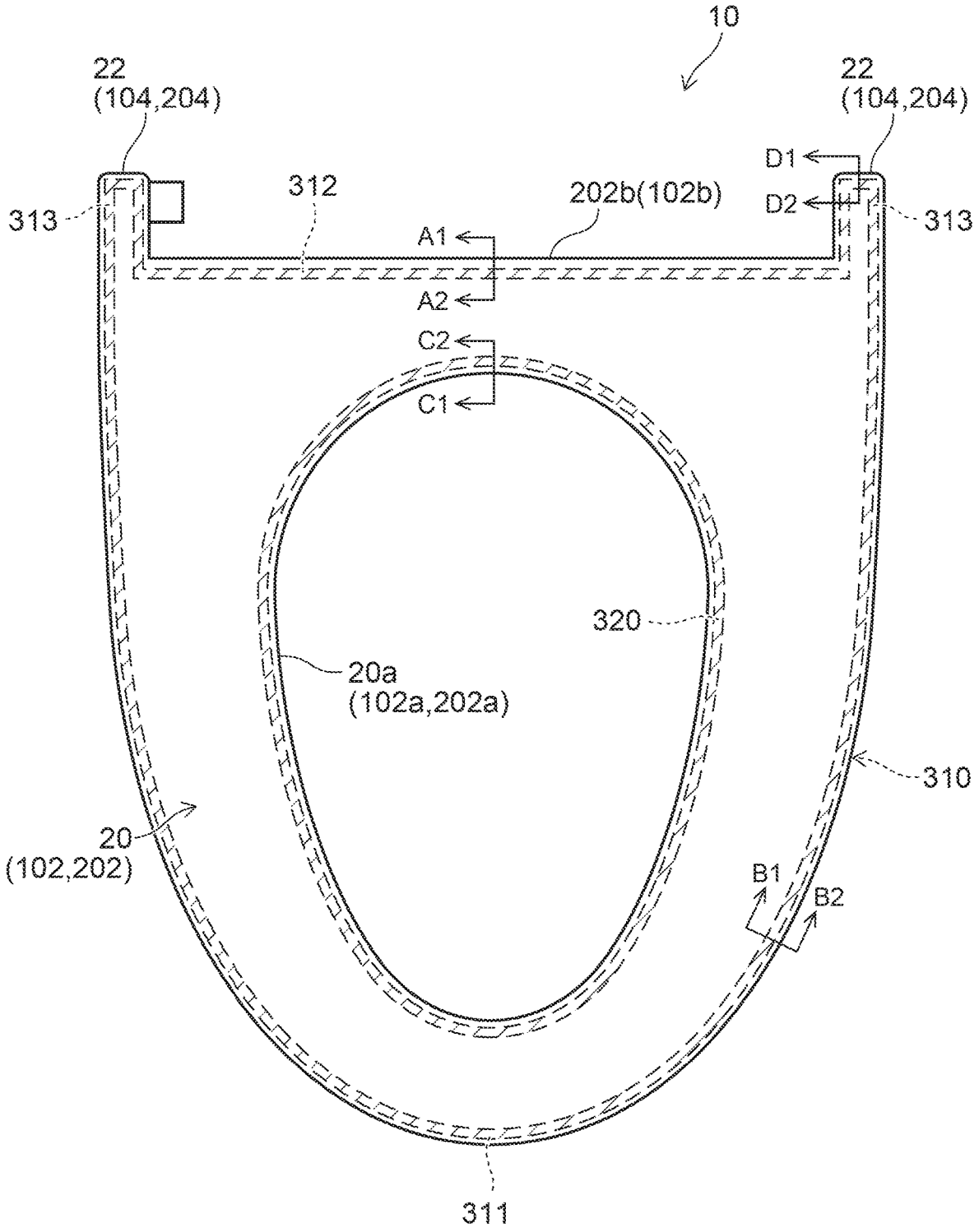
FIG. 4 is a plan view schematically illustrating the toilet seat according to the embodiment.

FIG. 4 is a plan view schematically illustrating the toilet seat according to the embodiment.

As illustrated in FIG. 4, the first bonding member 310 bonds the first outer edge portion 102*c* and the second outer edge portion 202*c*, bonds the first back end portion 102*b* and the second back end portion 202*b*, and bonds the pair of first hinge parts 104 and the pair of second hinge parts 204 on outer perimeter side of the bottom plate 100 and the top plate 200.

In other words, the first bonding member 310 has a first bonding region 311 where outer perimeter edges of the first outer edge portion 102*c* and the second outer edge portion 202*c* are bonded, a second bonding region 312 where outer perimeter edges of the first back end portion 102*b* and the second back end portion 202*b* are bonded, and a third bonding region 313 where outer perimeter edges of the pair of first hinge parts 104 and the second hinge parts 204 are bonded.

The second bonding member 320 bonds the open end of the first opening 102*a* and the open end of the second opening 202*a*.

As illustrated in FIG. 4, in the toilet seat 10, the first bonding member 310 bonds the outer perimeter sides of the bottom plate 100 and the top plate 200 over the entire circumference. In the toilet seat 10, the second bonding member 320 bonds the inner perimeter sides of the bottom plate 100 and the top plate 200 over the entire circumference. In other words, the first bonding member 310 has a ring configuration continuously extending along the outer perimeter edges of the bottom plate 100 and the top plate 200. The second bonding member 320 has a ring configuration continuously extending along the inner perimeter edges of the bottom plate 100 and the top plate 200.

However, the first bonding member 310 and the second bonding member 320 may be not always provided on the entire circumference of the bottom plate 100 and the top plate 200. The first bonding member 310 may has a broken off portion in the direction along the outer perimeter edge of the bottom plate 100 and the top plate 200. The second bonding member 320 may has a broken off portion in the direction along the inner perimeter edge of the bottom plate 100 and the top plate 200. The first bonding member 310 may have, for example, multiple portions provided to be arranged along the direction along the outer perimeter edges of the bottom plate 100 and the top plate 200. The second bonding member 320 may have, for example, multiple portions provided to be arranged along the direction along the inner perimeter edges of the bottom plate 100 and the top plate 200. In other words, the toilet seat 10 may include multiple first bonding members 310 arranged in the direction along the outer perimeter edges of the bottom plate 100 and the top plate 200. The toilet seat 10 may include multiple second bonding members 320 arranged in the direction along the inner perimeter edges of the bottom plate 100 and the top plate 200.

The bottom plate 100 includes an outer perimeter engaging part 121 and an inner perimeter engaging part 122. The outer perimeter engaging part 121 is provided along the outer perimeter edges of the first main part 102 and the pair of hinge parts 104. The outer perimeter engaging part 121 has a recess shape recessed downward. The outer perimeter engaging part 121 is provided, for example, over the entire circumference of the outer perimeter edges (outer perimeter edger of bottom plate 100) of the first main part 102 and the pair of hinge parts 104.

The inner perimeter engaging part 122 is provided along the inner perimeter edger of the first main part 102. The inner perimeter engaging part 122 has a recess shape recessed downward. The inner perimeter engaging part 122 is provided over the entire circumference of the inner perimeter edge of the first main part 102. The outer perimeter engaging part 121 and the inner perimeter engaging part 122 are, for example, V-shaped grooves with narrowing width toward downward.

The top plate 200 includes an outer perimeter sidewall part 221 and an inner perimeter sidewall part 222. The outer perimeter sidewall part 221 extends downward from the outer perimeter edges of the second main part 202 and the pair of second hinge parts 204. The inner perimeter sidewall part 222 extends downward from the inner perimeter edge of the second main part 202.

The first main part 102 and the second main part 202 are separated in a vertical direction. The outer perimeter sidewall part 221 and the inner perimeter sidewall part 222 are separated in a horizontal direction. Thereby, an interior space S surrounded by the bottom plate 100 and the top plate 200 is formed in the toilet seat 10.

In the case where the toilet seat 10 is U-shaped, the outer perimeter engaging part 121 and the inner perimeter engaging part 122 are connected on a front end side of the bottom plate 100, and the outer perimeter sidewall part 221 and the inner perimeter sidewall part 222 are connected on a front end side of the top plate 200. Similarly, in the case where the toilet seat 10 is U-shaped, the first bonding member 310 and the second bonding member 320 are connected on the front end side of the bottom plate 100 and the top plate 200.

Figure 5:
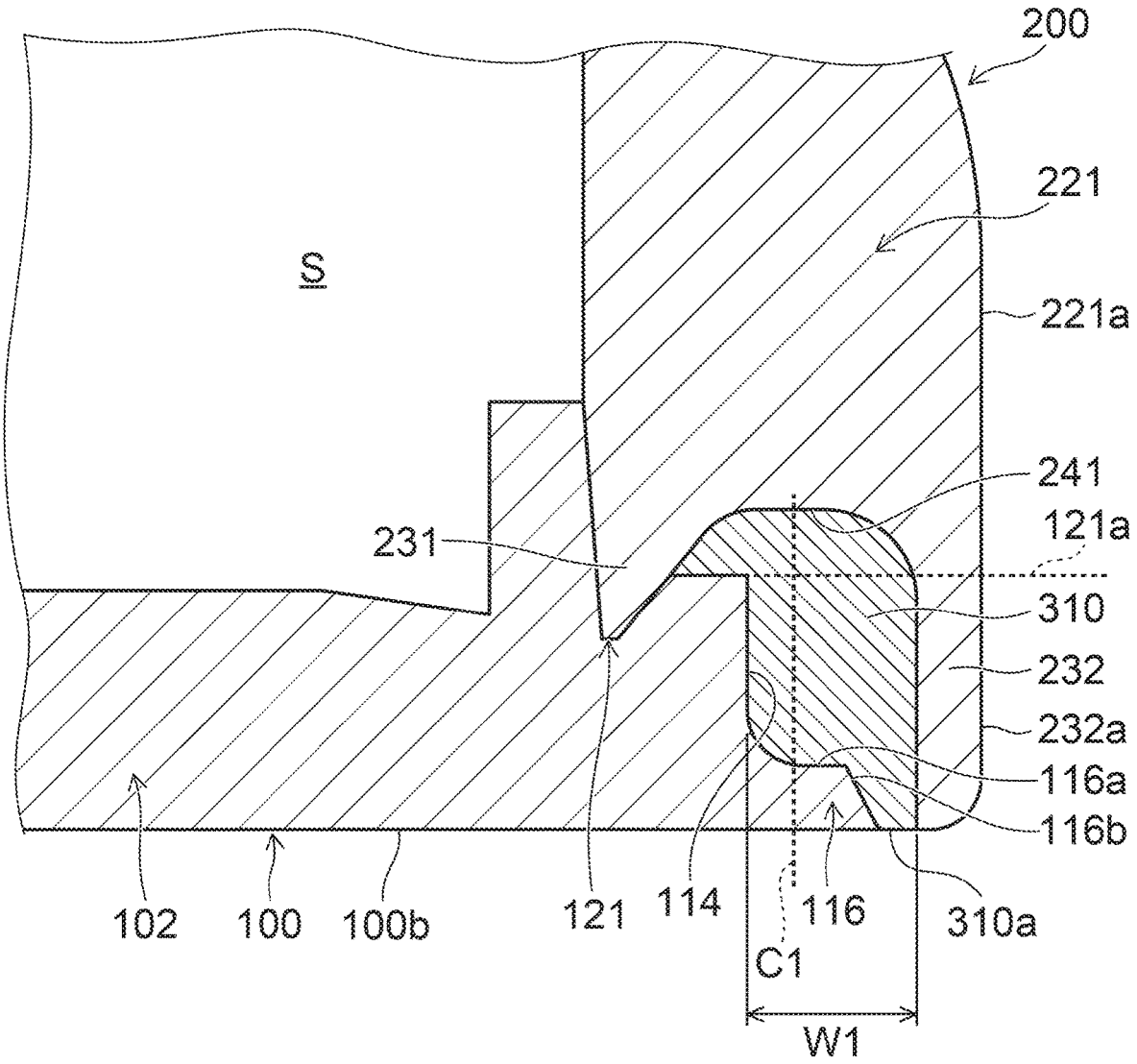
FIG. 5 is a cross sectional view enlarging a part of the cross section in FIG. 3.
Figure 6:
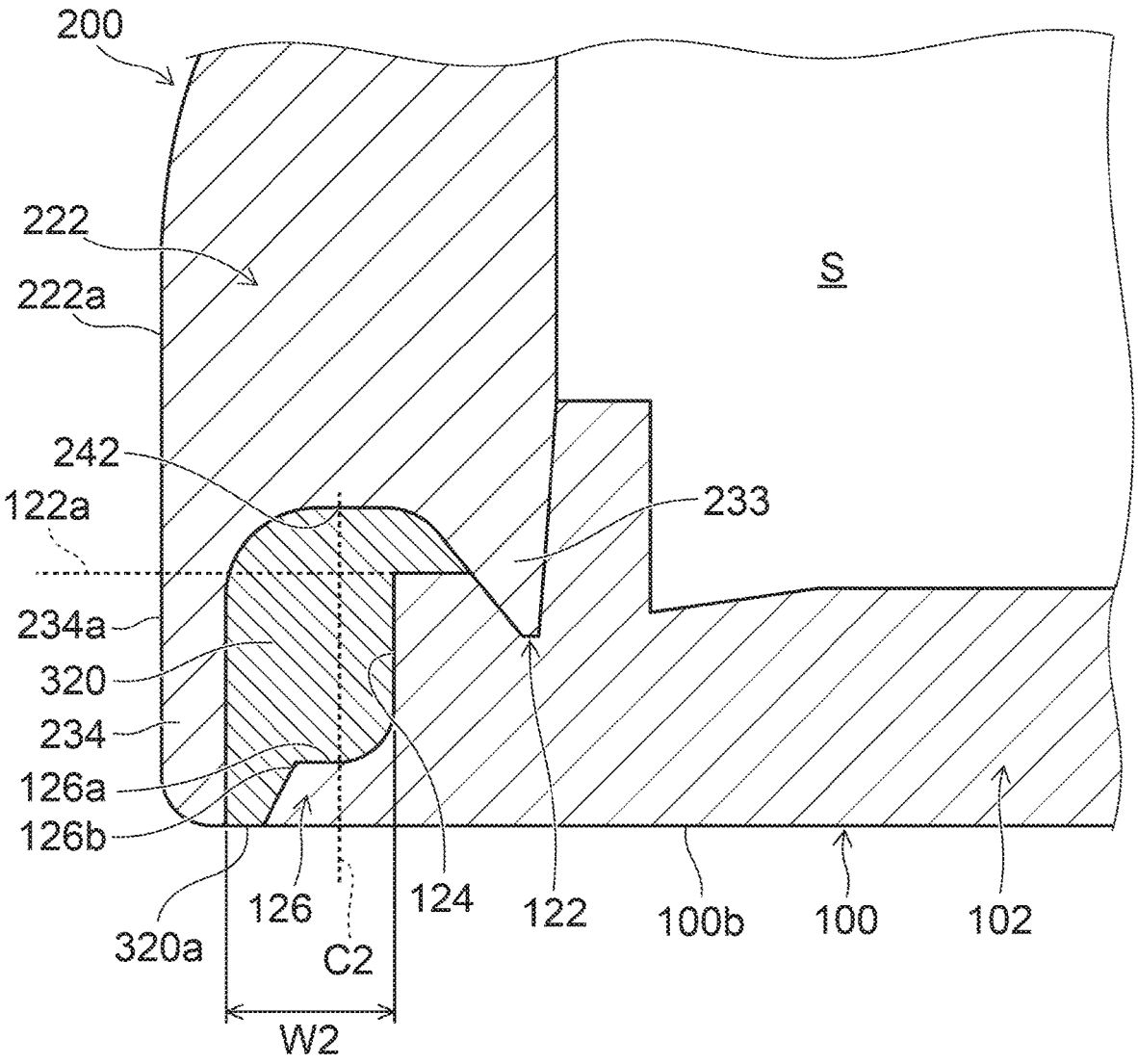
FIG. 6 is a cross sectional view enlarging a part of the cross section in FIG. 3.

FIG. 5 and FIG. 6 are cross sectional views enlarging a part of the cross section in FIG. 3.

FIG. 5 illustrates the part of the outer perimeter engaging part 121 and the part of the outer perimeter sidewall part 221. FIG. 6 illustrates the part of the inner perimeter engaging part 122 and the part of the inner perimeter sidewall part 222.

As illustrated in FIG. 5, the top plate 200 includes a first hanging part 231 and a second hanging part 232. The first hanging part 231 extends downward from a lower end of the outer perimeter sidewall part 221, overlaps on the bottom plate 100, and engages with the outer perimeter engaging part 121. The second hanging part 232 is provided on the lower end of the outer perimeter sidewall part 221. The second hanging part 232 is disposed on an outer perimeter side than the first hanging part 231 and is separated from the first hanging part 231. The first hanging part 231 and the second hanging part 232 provide a first recess 241. The first recess 241 is provided between the first hanging part 231 and the second hanging part 232. The first recess 241 recesses upward.

As illustrated in FIG. 6, the top plate 200 includes a third hanging part 233 and a fourth hanging part 234. The third hanging part 233 extends downward from a lower end of the inner perimeter sidewall part 222, overlaps on the bottom plate 100, and engages with the inner perimeter engaging part 122. The fourth hanging part 234 is provided on the lower end of the inner perimeter side wall part 222. The fourth hanging part 234 is disposed on an inner perimeter side than the third hanging part 233 and is separated from the third hanging part 233. The third hanging part 233 and the fourth hanging part 234 provide a second recess 242. The second recess 242 is provided between the third hanging part 233 and the fourth hanging part 234. The second recess 242 recesses upward.

The first bonding member 310 is provided in the first recess 241. The second bonding member 320 is provided in the second recess 242. Thereby, the bottom plater 100 and the top plate 200 are bonded by the first bonding member 310 and the second bonding member 320.

A resin material is, for example, used for the bottom plate 100, the top plate 200, the first bonding member 310, and the second bonding member 320. The bottom plate 100, the top plate 200, the first bonding member 310, and the second bonding member 320 include, for example, polypropylene, ABS (Acrylonitrile-Butadiene-Styrene), or PBT (Polybutylene Terephthalate), or polycarbonate-based composite material or the like.

The toilet seat 10 is manufactured, for example, by injecting a resin serving as the first bonding member 310 into the first recess 241 and injecting a resin serving as the second bonding member 320 into the second recess while keeping a state in which the bottom plate 100 and the top plate 200 are aligned by inserting the bottom plate 100 and the top plate 200 into the mold.

A width W1 of the first bonding member 310 is almost constant. For example, a width of the first bonding region 311 of the first bonding member 310 is substantially the same as a width of the second bonding region 312 and a width of the pair of the third bonding regions 313. In the example, the width W1 of the first bonding member 310 is almost constant over the entire circumference of the bottom plate 100 and the top plate 200. A width W2 of the second bonding member 320 is almost constant. In the example, the width W2 of the second bonding member 320 is almost constant over the entire circumference of the bottom plate 100 and the top plate 200.

Here, the width W1 of the first bonding member 310 is, for example, a width in a direction orthogonal to a direction along the outer perimeter edge of the bottom plate 100 and the top plate 200. The width W1 is, for example, the width of the first bonding member 310 in an upper end portion 121*a* of the outer perimeter engaging part 121. The width W2 is, for example, the width in a direction orthogonal to a direction along the inner perimeter edge of the bottom plate 100 and the top plate 200. The width W2 is the width of the second bonding member 320 in an upper end portion 122*a* of the inner perimeter engaging part 122. The widths W1, W2 being almost constant (substantially the same) means, for example, a state in which changes of the widths W1, W2 are not more than 2 mm. In other words, it means the state in which a difference between the maximum value and the minimum value of the widths W1, W2 is not more than 2 mm. However, the widths W1, W2 may be not always constant. The first bonding member 310 and the second bonding member 320 may have portions with different widths in part.

The second hanging part 232 is disposed at a position where the second hanging part does not overlap the bottom plate 100 in the vertical direction. The first bonding member 310 has a first exposed surface 310*a* exposing externally between the second hanging part 232 and the bottom plate 100. The first exposed surface 310*a* is disposed on an outer perimeter side of the center C1 in a width direction of the lower end of the outer perimeter sidewall part 221. The center C1 in the width direction of the lower end of the outer perimeter sidewall part 221 is, in other words, the center in a width direction of the outer perimeter sidewall part 221 in the upper end portion of the first recess 241 (first bonding member 310). In FIG. 5, the second hanging part 232 extends in almost vertical direction toward downward from the lower end of the outer perimeter sidewall part 221. Not limited to this, the second hanging part 232 may be inclined or curved to approach the bottom plate 100 as it goes downward.

The fourth hanging part 234 is disposed at a position where the fourth hanging part does not overlap the bottom plate 100 in the vertical direction. The second bonding member 320 has a second exposed surface 320*a* exposing externally between the fourth hanging part 234 and the bottom plate 100. The second exposed surface 320*a* is disposed on an inner perimeter side of the center C2 in a width direction of the lower end of the inner perimeter sidewall part 222. The center C2 in the width direction of the lower end of the inner perimeter sidewall part 222 is, in other words, the center in a width direction of the inner perimeter sidewall part 222 in the upper end portion of the second recess 242 (second bonding member 320). The width of the first exposed surface 310*a* in the direction orthogonal to the direction along the outer perimeter edge and the width of the second exposed surface 320*a* in the direction orthogonal to the direction along the inner perimeter edge are, for example, about 1 mm (for example, not less than 0.5 mm and not more than 3 mm). In FIG. 6, the fourth hanging part 234 extends in almost vertical direction toward downward from the lower end of the inner perimeter sidewall part 222. Not limited to this, the fourth hanging part 234 may be inclined or curved to approach the bottom plate 100 as it goes downward.

The first exposed surface 310*a* is almost coplanar with the lower end of the second hanging part 232. The first exposed surface 310*a* is almost coplanar with a bottom surface 100*b* of the bottom plate 100. Similarly, the second exposed surface 320*a* is almost coplanar with the lower end of the fourth hanging part 234 and the bottom surface 100*b* of the bottom plate 100. Thereby, it is able to suppress a gap or a step from occurring in the bonding portion of the bottom plate 100 and the top plate 200, and to improve cleanability of the toilet seat 10. Here, "almost coplanar" means that a height difference between adjacent two members is not more than 1 mm. More preferably, it is not more than 0.3 mm.

The second hanging part 232 has a side surface 232*a* facing an opposite side to the first recess 241. The side surface 232*a* is, in other words, a side surface facing outward. The side surface 232*a* of the second hanging part 232 is continuous with a side surface 221*a* facing outward of the outer perimeter sidewall part 221. That is, the step or the like is not provided between the outer perimeter sidewall part 221 and the second hanging part 232. Similarly, the fourth hanging part 234 has a side surface 234*a* facing an opposite side to the second recess 242. The side surface 234*a* of the fourth hanging part 234 is continuous with a side surface 222*a* facing inside of the inner perimeter sidewall part 222. Thereby, it is able to suppress that cleanability is decreased by the step or the like and a sense of comfort is given to the user by the step or the like hitting the bottom or leg or the like of the user.

The lower end portion of the side surface 232*a* of the second hanging part 232 faces the first recess 241 side, for example, by being curved to be in the form of a convex surface. The lower end portion of the side surface 234*a* of the fourth hanging part 234 faces the second recess 242 side, for example, by being curved to be in the form of a convex surface. In other words, the lower end portion of the second hanging part 232 and the lower end portion of the fourth hanging part 234 are so called R-chamfered.

The lower end portion of the side surface 232*a* of the second hanging part 232 may face the first recess 242 side, for example, by being inclined linearly. The lower end portion of the side surface 234*a* of the fourth hanging part 234 may face the second recess 242 side, for example, by being inclined linearly. In other words, the lower end portion of the second hanging part 232 and the lower end portion of the fourth hanging part 234 are so called C-chamfered. However, if the lower end portions of the side surfaces 232*a*, 234*a* are curved to be in the form of a convex surface, the occurrence of a horn or the like can be suppressed compared with the case of being inclined linearly. For example, it is able to suppress that a sense of comfort is given to the user by the bottom or leg or the like of the user hitting the horns or the like of the side surfaces 232*a*, 234*a*.

The widths of not curved or not inclined portions of the second hanging part 232, the fourth hanging part 234 in the direction orthogonal to the direction along the outer perimeter edge are not less than 1 mm and not more than 2 mm. Thereby, for example, while adequately suppressing the second hanging part 232, the fourth hanging part 234 from excessively thickening, pressures when filling the resin serving as the first bonding member 310, the second bonding member 320 can be received adequately at the second hanging part 232, the fourth hanging part 234.

The shape of the first hanging part 231 corresponds to the shape of the outer perimeter engaging part 121. The shape of the third hanging part 233 corresponds to the shape of the inner perimeter engaging part 122. As described previously, the outer perimeter engaging part 121 and the inner perimeter engaging part 122 are V-shaped grooves with narrowing width toward downward. In this case, the first hanging part 231 and the third hanging part 233 are V-shaped projections with narrowing width toward downward. Thereby, the first hanging part 231 engages the outer perimeter engaging part 121, and the third hanging part 233 engages the inner perimeter engaging part 122. By the engagement of the first hanging part 231 and the outer perimeter engaging part 121 and the engagement of the third hanging part 233 and the inner perimeter engaging part 122, for example, when injecting the resin serving as the first bonding member 310 and the second bonding member 320, the resin can be suppressed from flowing into the interior space S.

The bottom plate 100 includes an opposing surface 114 opposing the second hanging part 232 and a protruding part 116 extending from the lower end portion of the opposing surface 114 toward the second hanging part 232. The protruding part 116 has an upper surface 116*a* facing upward. At least a part of the upper surface 116*a* of the protruding part 116 is almost parallel to the bottom surface 100*b* of the bottom plater 100.

The protruding part 116 has a side surface 116*b* opposing the second hanging part 232. The side surface 116*b* of the protruding part 116 approaches the second hanging part 232 as it goes downward. The side surface 116*b* approaches the second hanging part 232 as it goes downward, for example, by being inclined linearly. The side surface 116*b* may approach the second hanging part 232 as it goes downward, for example, by being curved in the form of a convex surface or a concave surface. The surface opposing the side surface 116*b* of the second hanging part 232 may be inclined or curved to approach the protruding part 116 as it goes downward.

An angle between the upper surface 116*a* of the protruding part 116 and the bottom surface 100*b* of the bottom plate 100 is smaller than an angle between the side surface 116*b* of the protruding part 116 and the bottom surface 100*b* of the bottom plate 100. The upper surface 116*a* is not limited to a surface almost parallel to the bottom surface 100*b*, for example, may be a surface or the like having a looser slope than the side surface 116*b*. The shape of the protruding part 116 is not limited to the shape described above. The protruding part 116 may be, for example, an almost rectangular shape or the like having the almost planar shaped upper surface 116*a* and the almost vertical side surface 116*b*. Alternatively, the protruding part 116 may be, for example, a shape or the like having only the side surface 116*b* continuously inclining from the opposing surface 114.

The bottom plate 100 includes an opposing surface 124 opposing the fourth hanging part 234 and a protruding part 126 extending from the lower end portion of the opposing surface 124 toward the fourth hanging part 234. The protruding part 126 has an upper surface 126*a* facing upward and a side surface 126*b* opposing the fourth hanging part 234. Since the configuration of the opposing surface 124 and the protruding part 126 is substantially the same as the configuration of the opposing surface 114 and the protruding part 116, the detailed description will be omitted. The surface opposing the side surface 126*b* of the fourth hanging part 234 may be inclined or curved to approach the protruding part 126 as it goes downward similarly to the second hanging part 232.

Figure 7:
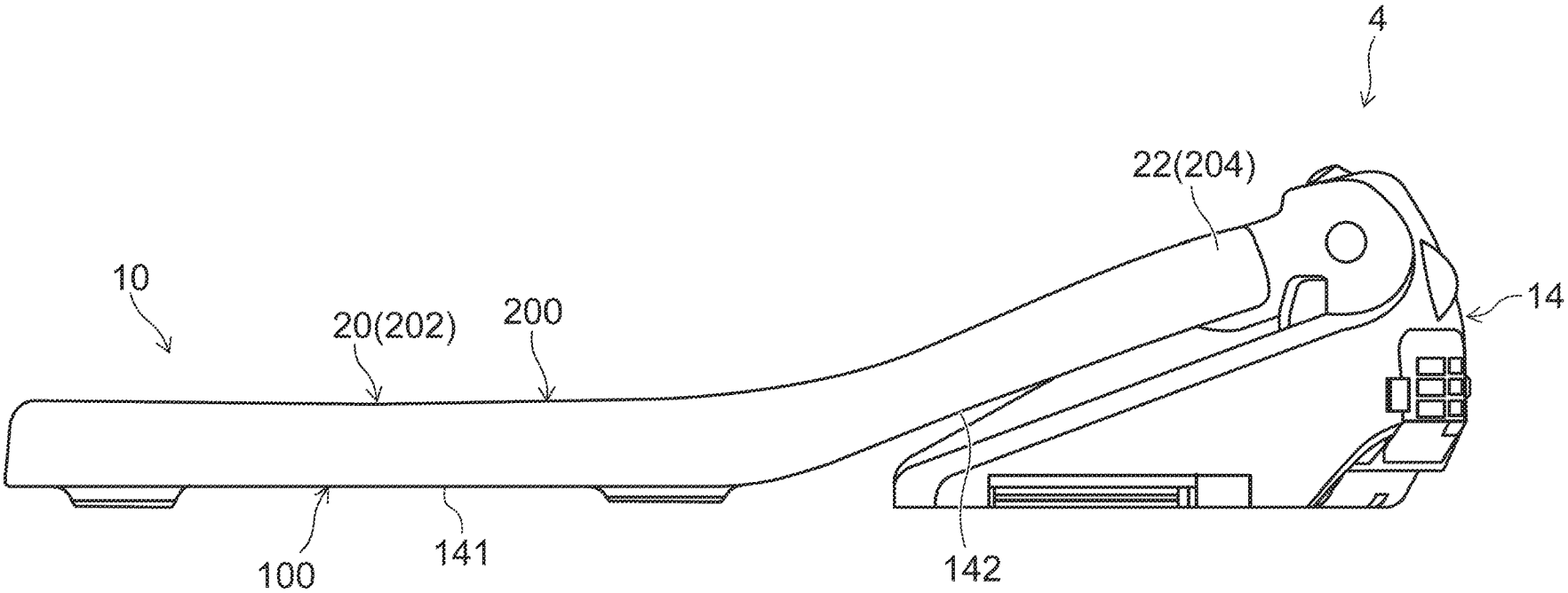
FIG. 7 is a side view schematically illustrating the toilet seat according to the embodiment.

FIG. 7 is a side view schematically illustrating the toilet seat according to the embodiment.

Figure 8:
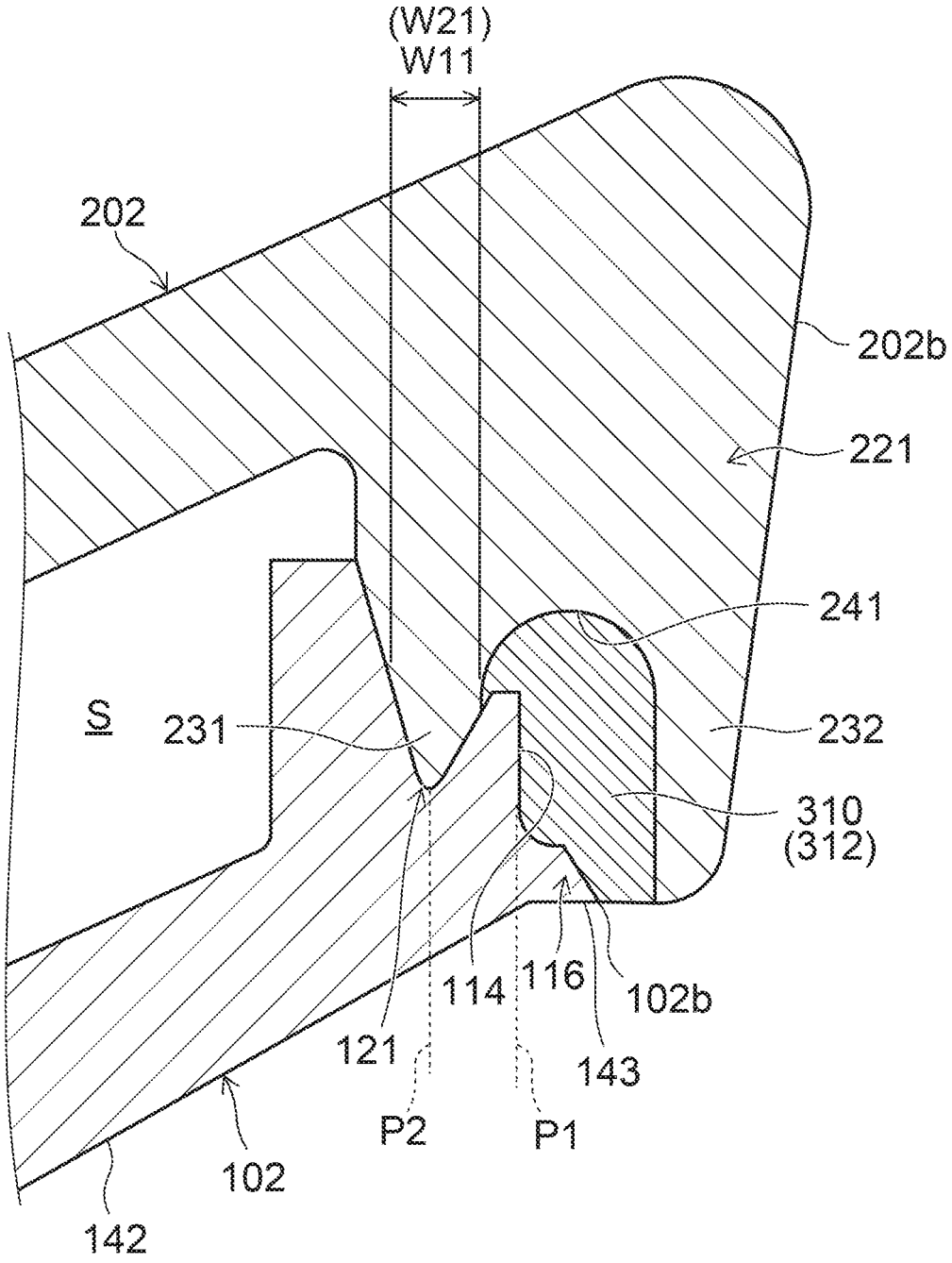
FIG. 8 is a partial cross sectional view schematically illustrating a part of the toilet seat according to the embodiment.

FIG. 8 is a partial cross sectional view schematically illustrating a part of the toilet seat according to the embodiment.

FIG. 8 schematically illustrates A1-A2 line cross section in FIG. 4.

As illustrated in FIG. 7 and FIG. 8, the first main part 102 of the bottom plate 100 includes a first portion 141, a second portion 142, and a third portion 143. The first portion 141 is a portion placed on the toilet 6. In a state in which the toilet seat 10 is placed on the toilet 6 and the user is possible to seat, the first portion 141 extends, for example, almost horizontally. Substantially horizontal is, for example, a state in which an angle from the horizontal plane is not more than ±5°.

The second portion 142 is inclined on the top plate 200 side as it goes backward from the first portion 141. In other words, the second portion 142 is inclined upward as it goes backward from the first portion 141 in a state in which the toilet seat 10 is placed on the toilet 6 and the user is possible to seat.

In the toilet seat 10, the bottom plate 100 and the top plate 200 are inclined upward as they go backward. Thereby, buttocks of a human body can be easily received and as illustrated in FIG. 7, the toilet seat 10 can be easily pivotally supported on a main part 14 of the toilet seat device 4.

Third portion 143 is provided between the second portion 142 and the first back end portion 102*b*. The first back end portion 102*b* is, in other words, a back end of the third portion 143. The third portion 143 extends almost horizontally backward from the second portion 142. The bottom surface of the third portion 143 is almost parallel to the bottom surface of the first portion 141. Almost parallel is, for example, a state in which an angle between two surfaces is not more than ±5°. In the state in which the toilet seat 10 is placed on the toilet 6 and the user is possible to seat, the bottom surface of the first portion 141 and the bottom surface of the third portion 143 are almost horizontal surfaces. On the other hand, a prescribed angle difference in accordance with the slope of the second portion 142 occurs between the bottom surface of the first portion 141 and the bottom surface of the third portion 143 and between the bottom surface of the first portion 141 and the bottom surface of the second portion 142. Therefore, the angle made by the bottom surface of the third portion 143 and the bottom surface of the first portion 141 is smaller than the angle made by the bottom surface of the third portion 143 and the bottom surface of the second portion 142.

It is preferable that the third portion 143 extends at least from the first back end portion 102*b* until a position P1 of the opposing surface 114. It is preferable that the third portion 143 is positioned backward of a position P2 of the lower end of the outer perimeter engaging part 121.

Figure 9:
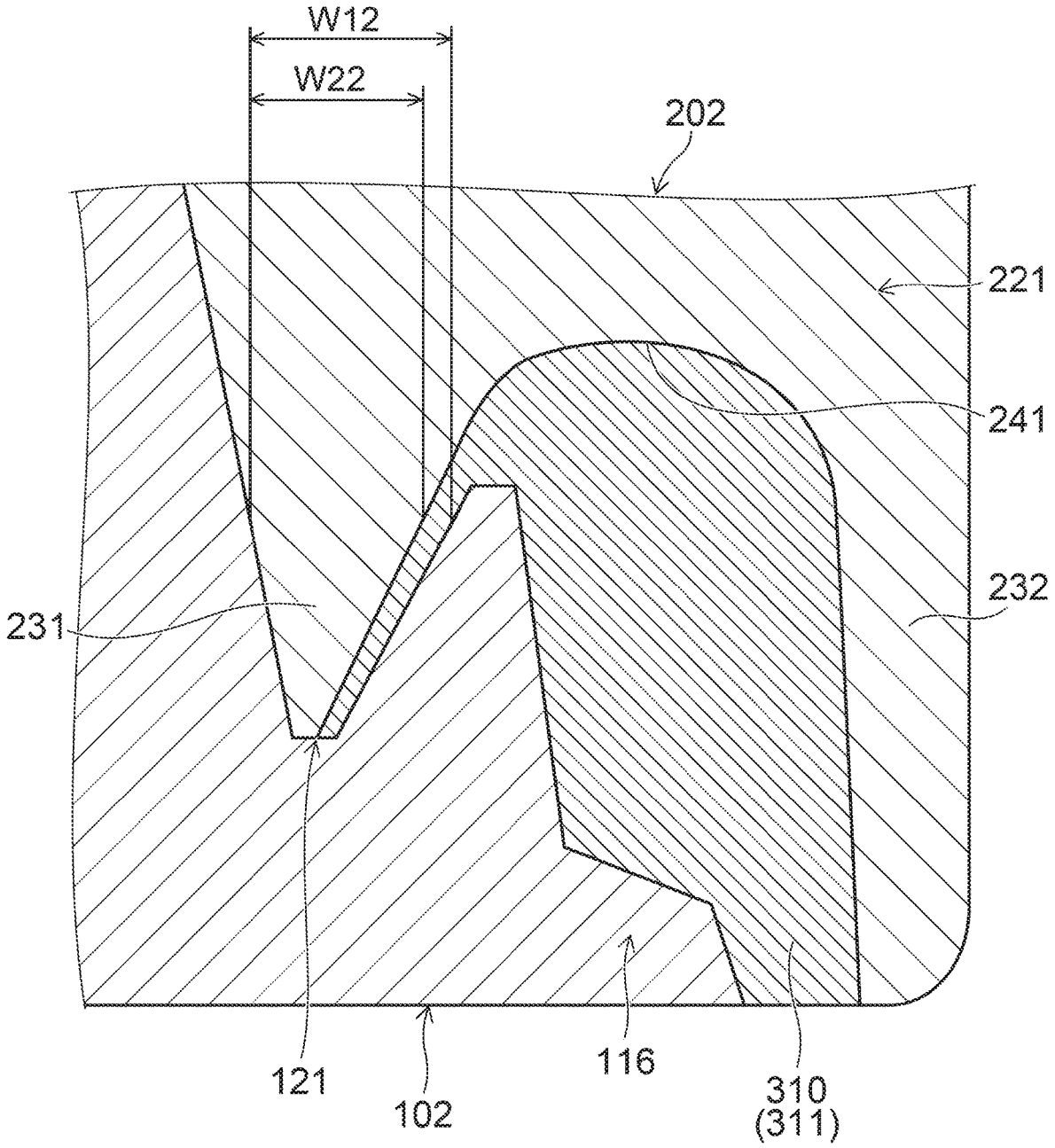
FIG. 9 is a partial cross sectional view schematically illustrating a part of the toilet seat according to the embodiment.
Figure 10:
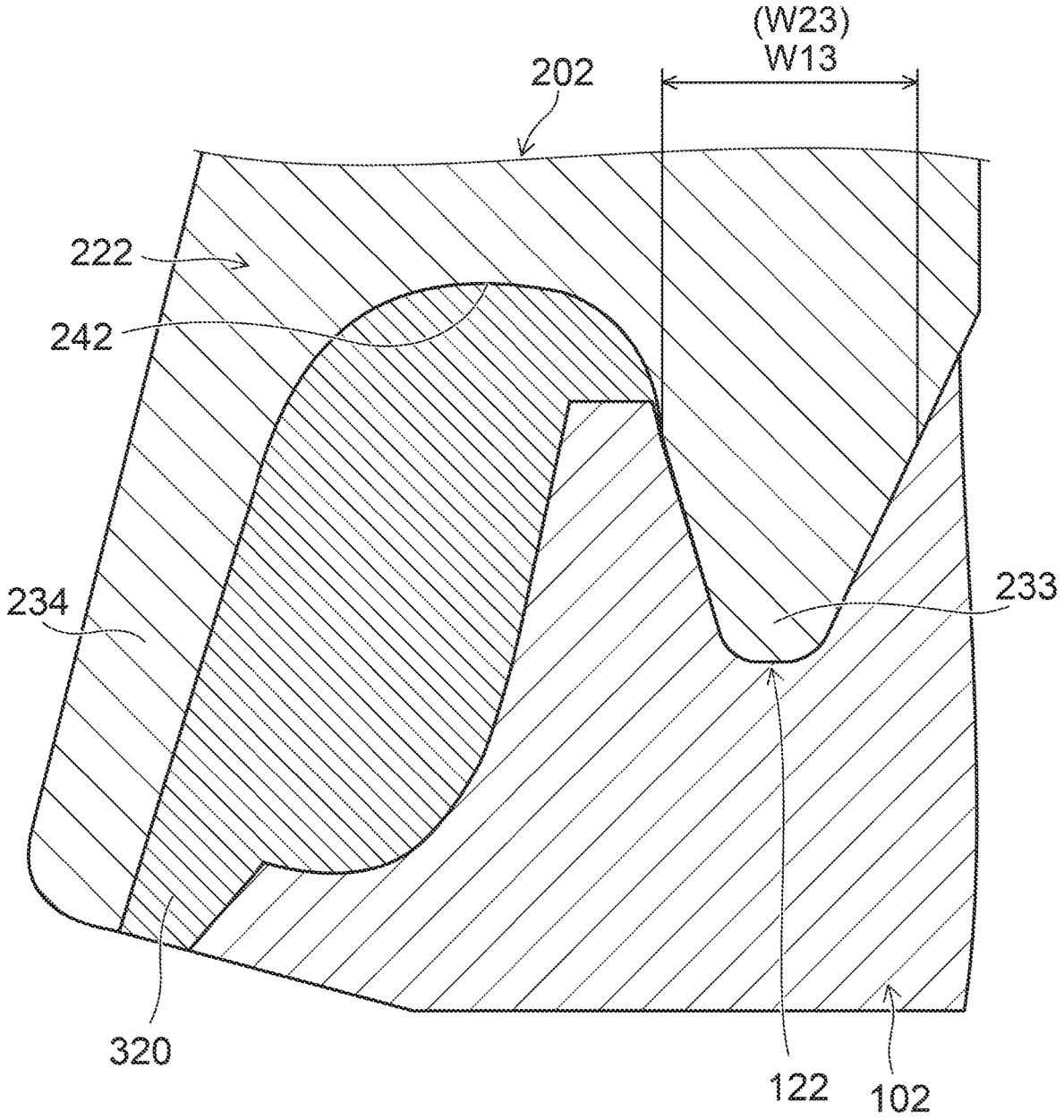
FIG. 10 is a partial cross sectional view schematically illustrating a part of the toilet seat according to the embodiment.
Figure 11:
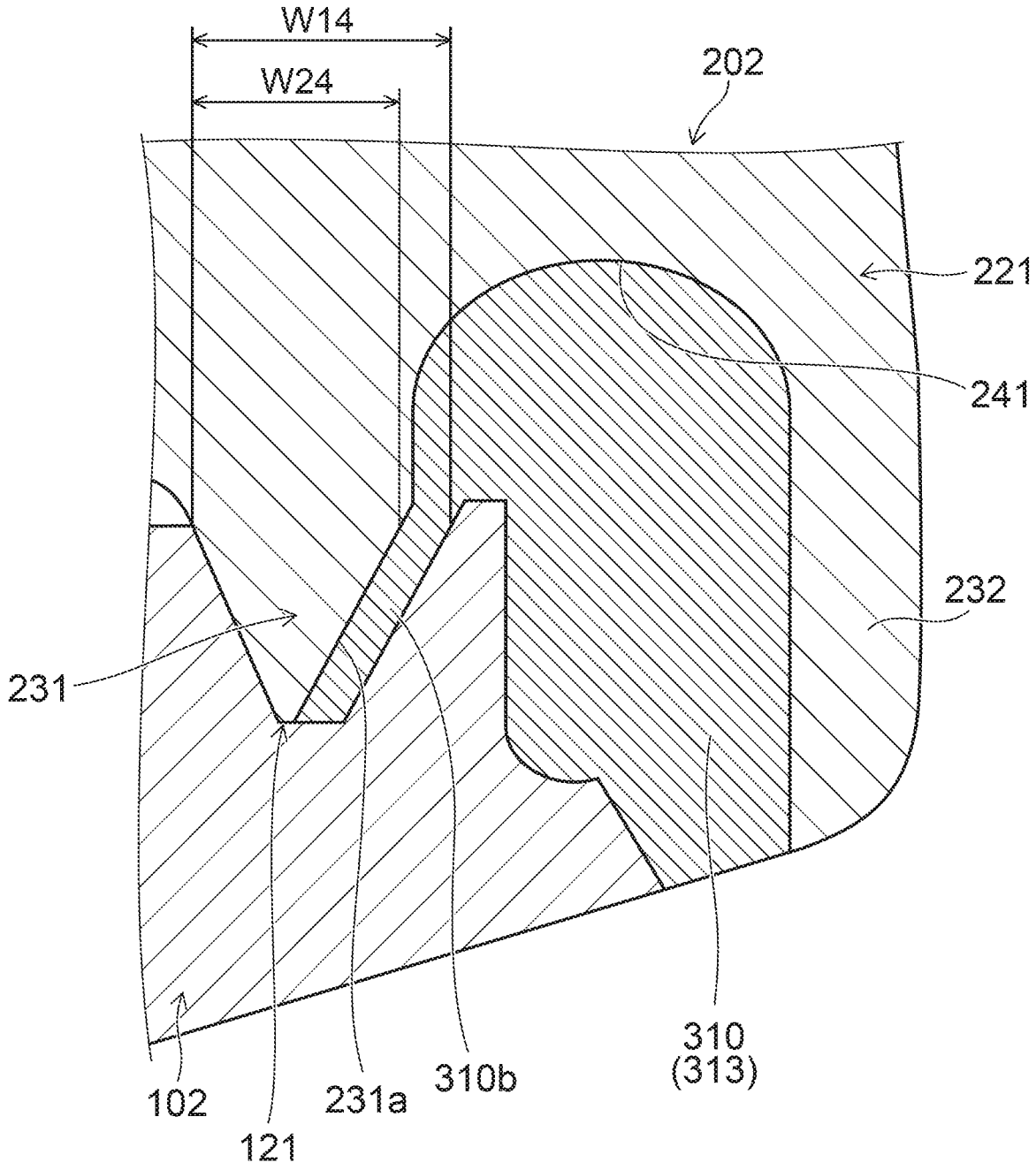
FIG. 11 is a partial cross sectional view schematically illustrating a part of the toilet seat according to the embodiment.

FIG. 9 to FIG. 11 are partial cross sectional views schematically illustrating a part of the toilet seat according to the embodiment.

FIG. 9 schematically illustrates B1-B2 line cross section in FIG. 4.

FIG. 10 schematically illustrates C1-C2 line cross section in FIG. 4.

FIG. 11 schematically illustrates D1-D2 line cross section in FIG. 4.

That is, FIG. 8 is a cross sectional view schematically illustrating a portion of the second bonding region 312 of the first bonding member 310, FIG. 9 is a cross sectional view illustrating a portion of the first bonding region 311 of the first bonding member 310, FIG. 10 is a cross sectional view illustrating the second bonding member 320, and FIG. 11 is a cross sectional view illustrating a portion of the third bonding region 313 of the first bonding member 310.

As illustrated in FIG. 8, a width W21 of the first hanging part 231 provided on the outer perimeter edge of the second back end portion 202*b* is, for example, substantially the same as a width W11 of the outer perimeter engaging part 121 provided on the outer perimeter edge of the first back end portion 102*b*. Therefore, a ratio (W21/W11) of the width W21 of the first hanging part 231 provided on the outer perimeter edge of the second back end portion 202*b* to the width W11 of the outer perimeter engaging part 121 provided on the outer perimeter edge of the first back end portion 102*b* is almost 1.

As illustrated in FIG. 9, a width W22 of the first hanging part 231 provided on the outer perimeter edge of the second outer edge portion 202*c* is, for example, slightly smaller than a width W12 of the outer perimeter engaging part 121 provided on the outer perimeter edge of the first outer edge portion 102*c*. Therefore, a ratio (W22/W12) of the width W22 of the first hanging part 231 provided on the outer perimeter edge of the second outer edge portion 202*c* to the width W12 of the outer perimeter engaging part 121 provided on the outer perimeter edge of the first outer edge portion 102*c* is slightly smaller than 1.

As illustrated in FIG. 10, a width W23 of the third hanging part 233 is, for example, substantially the same as a width W13 of the inner perimeter engaging part 122. Therefore, a ratio (W23/W13) of the width W23 of the third hanging part 233 to the width W13 of the inner perimeter engaging part 122 is almost 1.

On the other hand, as illustrated in FIG. 11, a width W24 of the first hanging part 231 provided on the outer perimeter edge of the pair of second hinge parts 204 is narrower than a width W14 of the outer perimeter engaging part 121 provided on the outer perimeter edge of the pair of first hinge parts 104 in comparison with the other portions. Therefore, a ratio (W24/W14) of the width W24 of the first hanging part 231 provided on the outer perimeter edge of the pair of second hinge parts 204 to the width W14 of the outer perimeter engaging part 121 provided on the outer perimeter edge of the pair of first hinge parts 104 is smaller than 1.

The widths W11 to W14 of the outer perimeter engaging part 121 and the widths W21 to W24 are widths at the same height of the outer perimeter engaging part 121 and the first hanging part 231, as illustrated in FIG. 8 to FIG. 11.

In this way, the ratio (W24/W14) of the width W24 of the first hanging part 231 provided on the outer perimeter edge of the pair of second hinge parts 204 to the width W14 of the outer perimeter engaging part 121 provided on the outer perimeter edge of the pair of first hinge parts 104 is smaller than the ratio (W22/W12) of the width W22 of the first hanging part 231 provided on the outer perimeter edge of the second outer edge portion 202*c* to the width W12 of the outer perimeter engaging part 121 provided on the outer perimeter edge of the first outer edge portion 102*c*, and the ratio (W23/W13) of the width W23 of the third hanging part 233 to the width W13 of the inner perimeter engaging part 122.

As illustrated in FIG. 11, an outer side surface 231*a* of the first hanging part 231 provided on the outer perimeter edge of the pair of second hinge parts 204 is disposed to be separated from the outer perimeter engaging part 121. A part 310*b* of the first bonding member 310 enters between the outer side surface 231*a* of the first hanging part 231 provided on the outer perimeter edge of the pair of second hinge parts 204 and the outer perimeter engaging part 121.

Figure 12:
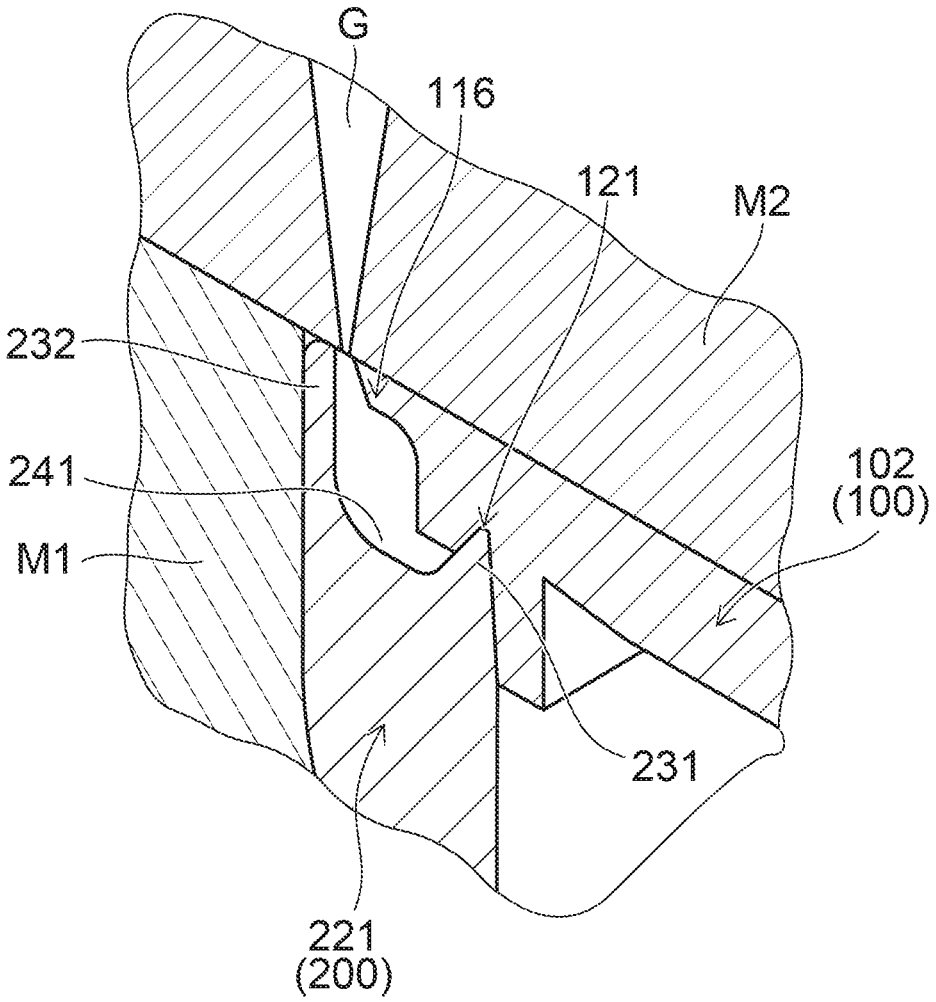
FIG. 12 is a cross sectional view illustrating a manufacturing process of the toilet seat according to the embodiment.

FIG. 12 is a cross sectional view illustrating a manufacturing process of the toilet seat according to the embodiment.

FIG. 12 illustrates a part of the outer perimeter engaging part 121 and a part of the inner perimeter sidewall part 221. As described above, the structures of the inner perimeter engaging part 122 and the inner perimeter side wall part 122 is similar to the structures of the outer perimeter engaging part 121 and the outer perimeter sidewall part 221. Therefore, the manufacturing process of the toilet seat 10 will be described with examples of the part of the outer perimeter engaging part 121 and the part of the outer perimeter sidewall part 221.

At first, the top plate 200 is placed on a mold M1 with the second main part 202 down. At this time, the top plate 200 is fit in the mold M1, and the outside surface of the top plate 200 is pressed by the mold M1. After that, the bottom plate 100 is disposed on the top plate 200. At this time, as illustrated in FIG. 12, the bottom plate 100 is disposed on the top plate 200 so that the first hanging part 231 of the outer perimeter sidewall part 221 is engaged with the outer perimeter engaging part 121 and a gap serving as an injection port is produced between the protruding part 116 and the second hanging part 232.

In this state, the bottom plate 100 is pressed downward by a mold M2. The mold M2 is provided with a gate G for injection a resin serving as the first bonding member 310 and the second bonding member 320. The mold M2 is disposed on the bottom plate 100 and the top plate 200 so that the gate G is positioned in the gap between the protruding part 116 and the second hanging part 232.

In this state, the heated resin is injected from the gap between the protruding part 116 and the second hanging part 232 into the first recess 241 through the gate G. When the heated resin is injected into the gap, planes contacting the resin of the bottom plate 100 and the top plate 200 are melted by heat, and mix with the resin. After that, the resin gets cooled to cure, and forms the first bonding member 310 and the second bonding member 320, and thereby the bottom plate 100 and the top plate 200 are bonded. For example, in the case where the bottom plate 100 and the top plate 200 are polypropylene, it is preferable to bond by using polypropylene, and a plasticization temperature and an injection temperature are preferable to be in a temperature range of not less than a melting point of the material and not more than 300° C. A high temperature side of this temperature range is adequate for obtaining high bonding strength, however it is preferable to set a condition in a range of a decomposition temperature or less depending on the resin for stable production. Even if in the case of bonding by using a resin material other than polypropylene, it is preferable to be as high as possible not less than the melting temperature, however a substantial temperature range is not more than the decomposition temperature under consideration of the productivity. After bonding the bottom plate 100 and the top plate 200, chamfer of the tip of the second hanging part 232 and deburring of the resin may be performed appropriately. From the above, the toilet seat 10 according to the embodiment is fabricated.

The mold M2 includes, for example, multiple gates arranged along the gap between the protruding part 116 and the second hanging part 232. The interval between the multiple gates G is, for example, set based on heat quantity for bonding. Specifically, it is determined by calculating a range (flow length) in which the heat quantity of solidifying a secondary resin flowing into an injection channel is sufficient for melting the surface layer of a primary resin (the bottom plate 100 and the top plate 200). For example, 200 mm corresponding to about ⅛ of the inner and outer circumference of the toilet seat 10 is set to be an upper limit, and the interval may be set appropriately within the range under consideration of the configuration of the mold M2 and manufacturability.

As described previously, since the first recess 241 melts with the first bonding member 310 each other, the interface is possible to be difficult to distinguish. In this case, for example, a portion having a higher component of the material of the top plate 200 than a component of the material of the first bonding member 310 may be the interface of the first recess 241.

As described above, in the toilet seat 10 according to the embodiment, the first bonding member 310 bonds the first outer edge portion 102*c* and the second outer edge portion 202*c*, bonds the first back end portion 102*b* and the second back end portion 202*b*, and bonds the pair of first hinge parts 104 and the pair of second hinge parts 204. Furthermore, the second bonding member 320 bonds the open end of the first opening 102*a* and the open end of the second opening 202*a*.

In the toilet seat 10, the pair of hinge parts 22 of the toilet seat 10 is formed by bonding the pair of first hinge parts 104 and the pair of second hinge parts 204. Thereby, in the toilet seat 10, without providing separate parts with high strength or making the volume large, high rigidity can be obtained at the pair of hinge parts 22 of the toilet seat 10. For example, even when the toilet seat 10 is fully open and a force is applied to press it further in the opening direction, it can be suppressed that a crack or the like occurs in the pair of hinge parts 22.

Furthermore, by bonding the inner and outer circumferences of the bottom plate 100 and the top plate 200 by the first bonding member 310 and the second bonding member 320, it can be suppressed that the joint or the step occurs between the bottom plate 100 and the top plate 200, and the decrease of cleanability and the decrease of creativity can be suppressed. Therefore, the toilet seat 10 with high rigidity and high cleanability which can be obtained by the simple configuration can be provided.

In the toilet seat 10, since the first bonding member 310 and the second bonding member 320 bond the outer perimeter side and the inner perimeter side of the bottom plate 100 and the top plate 200 over the entire circumference, high rigidity can be obtained. Furthermore, it can be suppressed that the joint or the step occurs over the entire circumference of the outer perimeter side and the inner perimeter side of the bottom plate 100 and the top plate 200, and the decrease of cleanability and the decrease of creativity can be more suppressed.

In the toilet seat 10, the first main part 102 of the bottom plate 100 includes the first portion 141, the second portion 142 which is inclined to the top plate 200 side as it goes backward from the first portion 141, and the third portion 143 between the second portion 142 and the first back end portion 102*b*, and an angle made by the bottom surface of the third portion 143 and the bottom surface of the first portion 141 is smaller than an angle made by the bottom surface of the third portion 143 and the bottom surface of the second portion 142.

For example, in the case where the bottom plate 100 includes only the first portion 141 and the second portion 142, and does not include the third portion 143, when the bottom plate 100 and the tip plate 200 are bonded by the first bonding member 310 and the second bonding member 320, the bottom plate 100 may move along the slope of the second portion 142 and deformation of the second portion 142 may occur. On the contrary, in the toilet seat 10, it can be suppressed that the bottom plate 100 moves along the slope of the second portion 142 and the second portion 142 deforms. Thereby, even when the inclined second portion 142 is provided, the bottom plate 100 and the top plate 200 can be bonded more adequately by the first bonding member 310 and the second bonding member 320, and higher rigidity can be obtained.

As described previously, it is preferable that the third portion 143 extends at least from the first back end portion 102*b* until the position P1 of the opposing surface 114. Thereby, the movement of the bottom plate 100 along the slope of the second portion 142 can be more adequately suppressed. It is preferable that the third portion 143 is positioned backward of the position P2 of the lower end of the outer perimeter engaging part 121. Thereby, it can be suppressed that the third portion 143 becomes excessively long. For example, it can be suppressed that a thickness of a portion between the third portion 143 and the outer perimeter engaging part 121 of the bottom plate 100 becomes thin, or the third portion 143 affects the shape or the like of the outer perimeter engaging part 121.

In the toilet seat 10, the first hanging part 231 engaging with the outer perimeter engaging part 121 and the third hanging part 233 engaging with the inner perimeter engaging part 122 are provided, and thus when the bottom plate 100 and the top plate 200 are bonded by the first bonding member 310 and the second bonding member 320, misalignment of the bottom plate 100 and the top plate 200 can be suppressed. For example, it can be suppressed that the widths W1, W2 of the first bonding member 310 and the second bonding member 320 change due to the misalignment of the top plate 200, and bias of the bonding strength occurs.

In the toilet seat 10, the portions of the pair of first hinge parts 104 and the pair of second hinge parts 204 have complicated shapes in comparison with the first main part 102 and the second main part 202, and it is easy to concentrate stress when bonding with the first bonding member 310 and the second bonding member 320.

In the toilet seat 10, for the portions of the pair of first hinge parts 104 and the pair of second hinge parts 204, a ratio (W24/W14) of the width W24 of the first hanging part 231 provided on the outer perimeter edge of the pair of second hinge parts 204 to the width W14 of the outer perimeter engaging part 121 provided on the outer perimeter edge of the pair of first hinge parts 104 is made smaller than that of the other portions.

Thereby, in the portions of the pair of first hinge parts 104 and the pair of second hinge parts 204, a play can be more provided than in the other portions when engaging the outer perimeter engaging part 121 with the first hanging part 231. The concentration of the stress to the portions of the pair of first hinge parts 104 and the pair of second hinge parts 204 can be relaxed by the play of the engagement of the outer perimeter engaging part 121 and the first hanging part 231.

For example, it can be suppressed that the toilet seat 10 is manufactured in the state in which a residual stress occurs in the portions of the pair of first hinge parts 104 and the pair of second hinge parts 204. It can be suppressed that, in the case where the toilet seat 10 is fully open and a force is applied to press it further in the opening direction, the crack or the like is easy to occur in the pair of hinge parts 22 by the residual stress. Therefore, the rigidity of the toilet seat 10 can be more increased.

In the toilet seat 10, the part 310*b* of the first bonding member 310 enters between the outer side surface 231*a* of the first hanging part 231 provided on the outer perimeter edge of the pair of second hinge parts 204 and the outer perimeter engaging part 121. Thereby, it can be suppressed that an air gap occurs between the first hanging part 231 and the outer perimeter engaging part 121. Thereby, it can be suppressed that, even when the play of the engagement of the outer perimeter engaging part 121 and the first hanging part 231 is made large, the rigidity is decreased due to the play. The rigidity of the pair of hinge parts 22 can be more improved, while suppressing the residual stress from occurring in the portions of the pair of first hinge parts 104 and the pair of second hinge parts 204.

In the toilet seat 10, the first exposed surface 310*a* is disposed on the outer perimeter side of the center C1 in the width direction of the lower end of the outer perimeter sidewall part 221, and the second exposed surface 320*a* is disposed on the inner perimeter side of the center C2 in the width direction of the lower end of the inner perimeter sidewall part 222, and thus the bonding strength by the first bonding member 310 and the second bonding member 320 can be more improved. Therefore, the rigidity of the toilet seat 10 can be more improved.

Embodiments of the invention are described above. However, the invention is not limited to these descriptions. Appropriate design modifications by one skilled in the art relating to the embodiments described above also are within the scope of the invention to the extent that the spirit of the invention is included. For example, the configurations, dimensions, material properties, arrangements, mounting methods, etc., of the components included in the toilet seat 10 are not limited to those illustrated and can be modified appropriately.

The components included in the embodiments described above can be combined within the extent of technical feasibility; and such combinations are within the scope of the invention to the extent that the spirit of the invention is included.

What is claimed is:

1. A toilet seat, comprising:

a bottom plate including a first main part and a pair of first hinge parts, the first main part including a first opening, the pair of first hinge parts being provided on both side ends of a first back end portion of the first main part;

a top plate provided on the bottom plate, the top plate including a second main part and a pair of second hinge parts, the second main part including a second opening opposing the first opening, the pair of second hinge parts being provided on both side ends of a second back end portion of the second main part;

a first bonding member bonding an outer perimeter side of the bottom plate and the top plate; and a second bonding member bonding an inner perimeter side of the bottom plate and the top plate, the first main part including a first outer edge portion positioned outside the first opening in front of the first back end portion and the pair of first hinge parts, the second main part including a second outer edge portion positioned outside the second opening in front of the second back end portion and the pair of second hinge parts, the top plate abutting the second edge portion on the first edge portion, abutting the second back end portion on the first back end portion, abutting the pair of second hinge parts on the pair of the first hinge parts, and abutting an open end of the second opening on an open end of the first opening, the second bonding member bonding the open end of the first opening and the open end of the second opening, the first bonding member bonding the first outer edge portion and the second outer edge portion, bonding the first back end portion and the second back end portion, and bonding the pair of first hinge parts and the pair of second hinge parts, the first main part includes a first portion, a second portion inclined to the top plate side as it goes backward from the first portion, and a third portion between the second portion and the first back end portion, and an angle made by a bottom surface of the third portion and a bottom surface of the first portion is smaller than an angle made by the bottom surface of the third portion and a bottom surface of the second portion.

2. The toilet seat according to claim 1, wherein the first bonding member bonds the outer perimeter side of the bottom plate and the top plate over an entire circumference, and the second bonding member bonds the inner perimeter side of the bottom plate and the top plate over an entire circumference.

3. The toilet seat according to claim 1, wherein the bottom plate includes an outer perimeter engaging part and an inner perimeter engaging part, the outer perimeter engaging part is provided along outer perimeter edges of the first main part and the pair of first hinge parts, the outer perimeter engaging part has a recessed shape, the inner perimeter engaging part is provided along an inner perimeter edge of the first main part, the inner perimeter engaging part has a recessed shape, the top plate includes an outer perimeter sidewall part extending downward from outer perimeter edges of the second main part and the pair of second hinge parts, a first hanging part extending downward from a lower end of the outer perimeter sidewall part, overlapping on the bottom plate, and engaging with the outer perimeter engaging part, a second hanging part provided on the lower end of the outer perimeter sidewall part, the second hanging part being disposed on an outer perimeter side than the first hanging part and being separated from the first hanging part, the first hanging part and the second hanging part providing a first recess, the first recess being provided between the first hanging part and the second hanging part and recessing upward, an inner perimeter sidewall part extending downward from an inner perimeter edge of the second main part, a third hanging part extending downward from a lower end of the inner perimeter sidewall part, overlapping on the bottom plate, and engaging with the inner perimeter engaging part, and a fourth hanging part provided on the lower end of the inner perimeter sidewall part, the fourth hanging part being disposed on an inner perimeter side than the third hanging part and being separated from the third hanging part, the third hanging part and the fourth hanging part providing a second recess, the second recess being provided between the third hanging part and the fourth hanging part and recessing upward, the first bonding member is provided in the first recess, and the second bonding member is provided in the second recess.

4. The toilet seat according to claim 3, wherein a ratio of a width of the first hanging part provided on an outer perimeter edge of the pair of second hinge parts to a width of the outer perimeter engaging part provided on an outer perimeter edge of the pair of first hinge parts is smaller than a ratio of a width of the first hanging part provided on an outer perimeter edge of the second outer edge portion to a width of the outer perimeter engaging part provided on an outer perimeter edge of the first outer edge portion, a ratio of a width of the first hanging part provided on an outer perimeter edge of the second back end portion to a width of the outer perimeter engaging part provided on an outer perimeter edge of the first back end portion, and a ratio of a width of the third hanging part to a width of the inner perimeter engaging part.

5. The toilet seat according to claim 4, wherein an outer side surface of the first hanging part provided the outer perimeter edge of the pair of second hinge parts is disposed to be separated from the outer perimeter engaging part, and a part of the first bonding member enters between the outer side surface of the first hanging part provided on the outer perimeter edge of the pair of second hinge parts and the outer perimeter engaging part.

6. The toilet seat according to claim 3, wherein the second hanging part and the fourth hanging part are disposed at a position where the second hanging part and the fourth hanging part do not overlap the bottom plate in a vertical direction, the first bonding member includes a first exposed surface exposing externally between the second hanging part and the bottom plate, the second bonding member includes a second exposed surface exposing externally between the fourth hanging part and the bottom plate, the first exposed surface is disposed on an outer perimeter side of a center in a width direction of the lower end of the outer perimeter sidewall part, and the second exposed surface is disposed on an inner perimeter side of a center in a width direction of the lower end of the inner perimeter sidewall part.

* * * * *